US006364557B1

(12) United States Patent
Dougherty

(10) Patent No.: US 6,364,557 B1
(45) Date of Patent: Apr. 2, 2002

(54) VALVE ARRANGEMENT FOR HAND HELD LIQUID APPLICATOR

(76) Inventor: Barbara Dougherty, 2926 Copper Beach La., Secane, PA (US) 19018

( * ) Notice: Subject to any disclaimer, the term of this patent is extended or adjusted under 35 U.S.C. 154(b) by 0 days.

(21) Appl. No.: 09/557,532

(22) Filed: Apr. 24, 2000

(51) Int. Cl.[7] ..... A46B 11/02

(52) U.S. Cl. ..... 401/183; 401/186; 401/274; 401/275

(58) Field of Search ..... 401/152, 156, 401/183, 184, 186, 274, 275, 287

(56) References Cited

U.S. PATENT DOCUMENTS

| | | | | | |
|---|---|---|---|---|---|
| 818,666 | A | * | 4/1906 | Caddell et al. | 401/274 |
| 2,726,417 | A | * | 12/1955 | Rowser et al. | 401/183 |
| 2,789,300 | A | * | 4/1957 | Beller | 401/274 |
| 3,372,426 | A | * | 3/1968 | Schwartzman | 401/183 |
| 4,415,288 | A | * | 11/1983 | Gordon et al. | 401/156 |
| 4,429,434 | A | * | 2/1984 | Sung-shan | 401/183 |
| 5,087,138 | A | | 2/1992 | Terbrusch et al. | 401/206 |
| 5,259,682 | A | * | 11/1993 | Uchiyama | 401/186 |
| 5,454,659 | A | | 10/1995 | Vosbikian et al. | 401/207 |
| 5,878,459 | A | | 3/1999 | McParland | 15/114 |
| 5,945,076 | A | | 8/1999 | Leonard et al. | 422/300 |
| 5,961,235 | A | | 10/1999 | Kennedy | 401/6 |
| 5,984,555 | A | * | 11/1999 | Samad | 401/287 |

* cited by examiner

*Primary Examiner*—Charles R. Eloshway

(57) ABSTRACT

A liquid applicator arrangement (10) comprising an applicator unit (11) having an applicator head member (20) provided with apertures (21) and bristles, and further including an elongated neck element (23) provided with a stepped shoulder portion (24) which defines a valve seat (25) dimensioned to receive a ball valve member (40), and an elongated handle member (30) having flexible walls which define a liquid reservoir (32) in the handle member (30). The lower end (33) of the handle member (30) is fixedly secured to the exterior of the stepped shoulder portion (24) of the applicator head member (20).

5 Claims, 1 Drawing Sheet

VALVE ARRANGEMENT FOR HAND HELD LIQUID APPLICATOR

BACKGROUND OF THE INVENTION

1. Field of the Invention

The present invention relates in general to the field of liquid applicators having self-contained liquid reservoirs that feed an applicator head, and in particular to a valve arrangement for such a device which controls the flow of fluid from the reservoir to the applicator head.

2. Description of Related Art

As can be seen by reference to the following U.S. Pat. Nos. 5,087,138; 5,454,659; 5,878,459; 5,945,076, and 5,961,235, the prior art is replete with myriad and diverse liquid applicators having fluid reservoirs that are directly connected to the applicator head.

While all of the aforementioned prior art constructions are more than adequate for the basic purpose and function for which they have been specifically designed, they are uniformly deficient with respect to their failure to provide a simple, efficient, and practical valve arrangement that controls the flow of liquid from the liquid reservoir to the applicator head during use.

As most people who have employed liquid applicators of the aforementioned type are well aware, one of the main problems encountered with this type of an applicator is their lack of an internal valve mechanism which can control the flow of liquid between the fluid reservoir and the applicator head.

As a consequence of the foregoing situation, there has existed a longstanding need for a new and improved valve mechanism for devices of this type which will allow a predetermined volume of liquid to escape from the reservoir during each use and will selectively prevent additional liquid from reaching the applicator head except when needed, and the provision of such an arrangement is a stated objective of the present invention.

BRIEF SUMMARY OF THE INVENTION

Briefly stated, the arrangement that forms the basis of the present invention comprises in general, an applicator unit mounted on a handle unit which forms a liquid reservoir and a valve unit disposed within the handle unit for controlling the flow of liquid from the reservoir to the applicator unit.

As will be explained in greater detail further on in the specification, in the preferred embodiment of the invention, the liquid applicator arrangement is configured as a long handled toilet bowl scrub brush. The applicator unit includes a hollow applicator head member provided with apertures and bristles and including a hollow neck element provided with a stepped shoulder portion that defines a valve seat dimensioned to sealingly engage the valve unit that comprises a weighted ball valve member.

In addition, the handle unit includes an elongated flexible walled handle member whose interior defines a liquid reservoir. The upper end of the handle member is provided with a hinged cap, and the lower end of the handle member is secured to the stepped shoulder portion of the applicator head member. The manual compression of the flexible wall of the handle member will force liquid from the liquid reservoir past the ball valve member and into and through the applicator head member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2, 3, 4, 5:
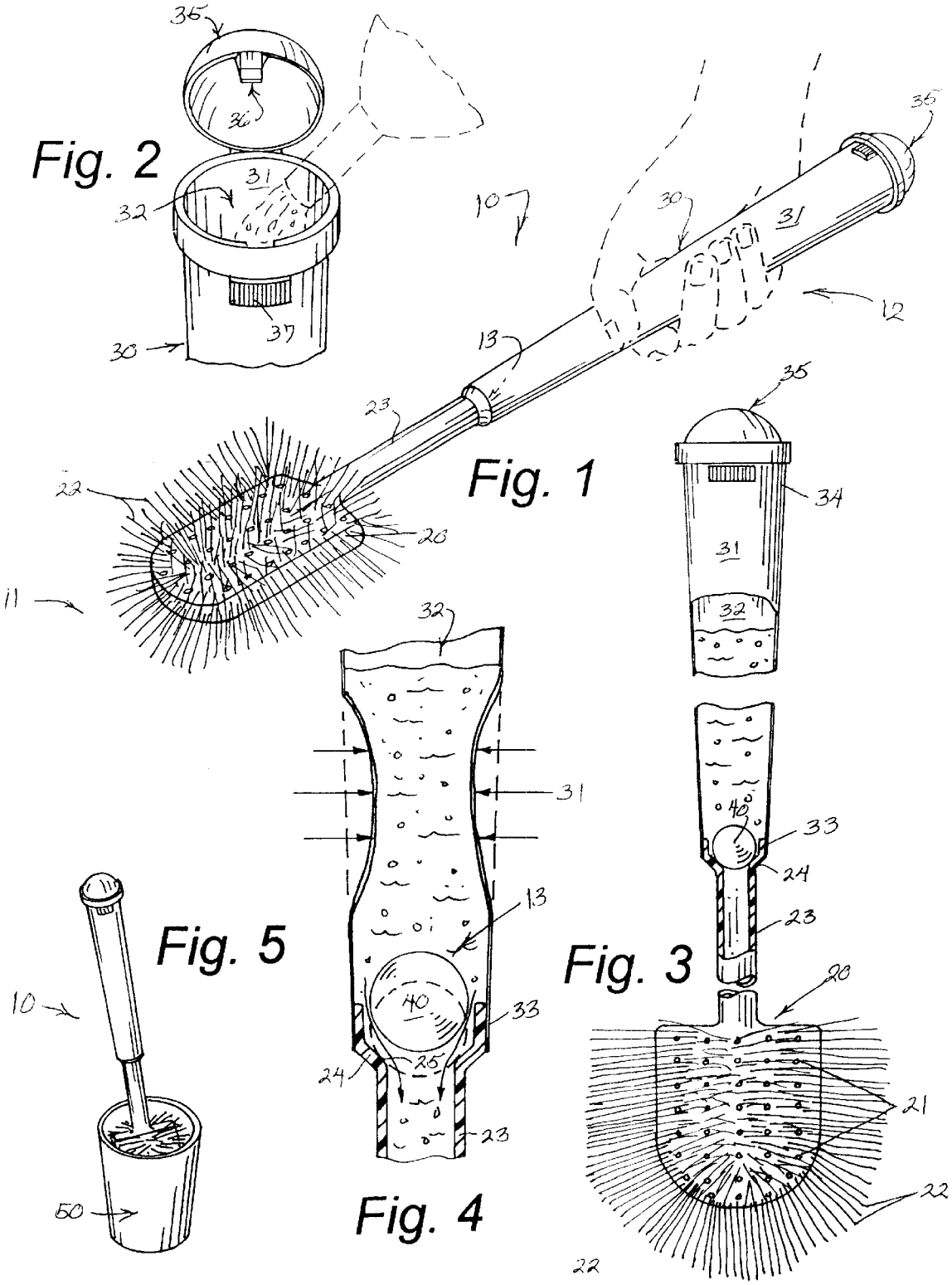
FIG. 1 is perspective view of a liquid applicator equipped with the valve arrangement of the present invention.
FIG. 2 is an isolated detail view of the proximal end of the handle unit.
FIG. 3 is a partial cut away front plan view of the liquid applicator.
FIG. 4 is a cross sectional detail view of the cooperation between the valve unit and the handle unit.
FIG. 5 is a perspective view of the applicator member disposed in a storage receptacle between uses.

As can be seen by reference to the drawings, and in particular to FIG. 1, the hand held liquid applicator construction that forms the basis of the present invention is designated generally by the reference number 10. The construction 10 comprises in general, an applicator unit 11, a handle unit 12, and a valve unit 13. These units will now be described in seriatim fashion.

As shown in FIGS. 1 and 3, the applicator unit 11 includes an enlarged generally rigid, hollow applicator head member 20 having a lower end provided with a plurality of liquid dispensing apertures 21 that are dispersed around the periphery of the applicator head member 20 and surrounded by an array of bristles 22 arranged into a scrubbing brush configuration. The upper end of the applicator head member 20 is provided with an elongated generally cylindrical hollow neck element 23 which is in open fluid communication with the interior of the applicator head member 20.

In addition, as shown in FIGS. 3 and 4, the upper end of the neck element 23 is provided with an outwardly extending stepped shoulder portion 24 whose interior surface defines a valve seat 25 as will be described in greater detail further on in the specification.

Turning now to FIGS. 2 through 4, it can be seen that the handle unit 12 comprises in general, an elongated generally tapered hollow handle member 30 provided with generally flexible walls 31 which define an internal fluid reservoir 32. The lower end 33 of the handle member 30 is fixedly secured to the external periphery of the stepped shoulder portion 24 of the neck element 23 of the applicator head member 20.

In addition, as shown in FIGS. 2 and 3, the upper end 34 of the handle member is provided with a hinged cap element 35 having a catch 36 that may be releasably engaged by a push button release 37 in a well recognized manner to allow for the liquid reservoir to be replenished.

Returning once more to FIGS. 3 and 4, it can be seen that the valve unit 13 comprises a weighted ball valve member 40 that is dimensioned to sealingly engage the valve seat 25 formed at the top of the neck element 23 of the applicator head member 20 to normally prevent any of the liquid contents of the reservoir 32 from being delivered to the applicator head member 20 when the handle member 30 is in the vertically upright position.

In the preferred embodiment of the invention depicted in FIG. 5, the applicator arrangement 10 is intended for use as a toilet scrub brush that is held in an upright position by a suitable storage receptacle.

When the user wishes to employ the arrangement 10 in its intended manner, all that is required is for manual pressure to be applied to the flexible walls 31 of the handle member

30 after the handle member has been tilted to a generally horizontal position to lift the ball valve 40 from the valve seat 25 to allow liquid soap or other cleaning/disinfecting liquid to flow by gravity from the reservoir 32 to the applicator head member 20 and through the apertures 21. The liquid will be dispersed by the bristles 22 to clean and disinfect a toilet bowl.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A hand held liquid applicator consisting of:

an applicator unit including a hollow applicator head member having a lower end provided with a plurality of apertures which are in open communication with the exterior surface of the applicator head member which is further provided with a plurality of bristles and having an upper end provided with a neck element including an outwardly projecting stepped shoulder portion forming a valve seat;

a handle unit including an elongated tapered handle member provided with flexible walls that define an interior liquid reservoir wherein the handle member has a lower end fixedly secured to the stepped shoulder portion of the applicator head member wherein the handle member has an upper end provided with a cap element that is hingedly connected to the upper end of the handle member and further provided with a catch; and wherein the upper end of the handle member is further provided with a push button release that is releasably engageable with said catch; and, a valve unit including a weighted ball valve member dimensioned to be received in the stepped shoulder portion of the applicator member.

2. The arrangement as in claim 1 wherein the handle member has an upper end provided with a cap element.

3. The arrangement as in claim 2 wherein the cap element is hingedly connected to the upper end of the handle member.

4. The arrangement as in claim 3 wherein the cap element is provided with a catch.

5. The arrangement as in claim 4 wherein the upper end of the handle member is further provided with a push button release that is releasably engageable with said catch.

* * * * *